US005193808A

United States Patent [19]

Takeshi

[11] Patent Number: 5,193,808

[45] Date of Patent: Mar. 16, 1993

[54] TOY GAME APPARATUS

[75] Inventor: Sano Takeshi, Yono, Japan

[73] Assignee: Asahi Corporation, Tokyo, Japan

[21] Appl. No.: 857,758

[22] Filed: Mar. 26, 1992

[30] Foreign Application Priority Data

Mar. 29, 1991 [JP] Japan ..... 3-027107[U]

[51] Int. Cl.[5] ..... A63F 9/00; A63H 3/36

[52] U.S. Cl. ..... 273/138 R; 273/447; 446/339; 446/395

[58] Field of Search ..... 273/138 R, 447, 448; 446/339, 395

[56] References Cited

U.S. PATENT DOCUMENTS 3,994,492 11/1976 Breslow ..... 273/447

4,298,199 11/1981 Bush et al. ..... 273/448

FOREIGN PATENT DOCUMENTS 2067902 8/1981 United Kingdom ..... 273/447

*Primary Examiner*—Benjamin H. Layno

*Attorney, Agent, or Firm*—Salter, Michaelson & Benson

[57] ABSTRACT

A toy game apparatus includes a character figure assembly having a mouth portion which is movable to an open position, a plurality of teeth removably received in the mouth portion, and a pliers-like instrument for removing the teeth from the mouth portion. The toy game apparatus further includes a mechanism for automatically moving the mouth portion to a closed position, propelling the game apparatus forwardly, and producing a screeching sound when a randomly preselected tooth is removed from the mouth portion.

12 Claims, 5 Drawing Sheets

TOY GAME APPARATUS

BACKGROUND AND SUMMARY OF THE INVENTION

The instant invention relates to amusement games, and more particularly to an amusing toy game apparatus which is operable in an exciting random game format for providing a substantial level of continuous entertainment for game players.

Amusement games wherein game players interact with amusing game apparatus, particularly game apparatus which resemble interesting character figures, have been found to have high levels of appeal. Further, amusement games of this type which comprise game apparatus for performing interesting types of game activities, and which require game players to perform specific types of manipulations during the course of game play, have been found to have even greater levels of appeal. Even still further, games of this type which comprise game apparatus which are operative for randomly affecting game play have been found to have particularly high levels of appeal.

The instant invention provides an amusing and interesting game apparatus comprising a character figure which is operable during the course of game play for randomly interacting with game players. More specifically, the instant invention provides a toy game apparatus comprising a character figure including a mouth portion having a plurality of teeth therein which are removable from the mouth portion by game players during the course of game play. Still more specifically, the instant invention provides a toy game apparatus which includes a character figure having a mouth portion which is movable between open and closed positions, and which has a plurality of game piece receiving sockets therein. The apparatus further comprises a plurality of game pieces which are preferably embodied as teeth of the character figure, and which are removably received in the game piece receiving sockets. The game apparatus further includes an operating mechanism which is operative for releasably retaining the mouth portion in an open position and for detecting the removal of a randomly predetermined one of the game pieces from the receiving socket thereof. The operating mechanism is responsive to the removal of the randomly predetermined game piece from the receiving socket thereof for automatically moving the mouth portion to the closed position thereof. The game pieces, which are preferably embodied as teeth, are preferably positioned adjacent the perimeter of the lower jaw of the mouth portion. Further, each of the teeth preferably includes a pair of spaced, resilient, downwardly-extending root portions which are releasably receivable in engagement in the socket portions for releasably securing the teeth therein. The root portions are deflectable inwardly and together for individually releasing the teeth from the socket portions, and the apparatus preferably further comprises a scissors-like pliers tool which is engageable with the root portions of the teeth for individually removing the teeth from the socket portions thereof. The toy game apparatus preferably further includes a plurality of wheels for movably supporting the character figure on a supporting surface, and the operating mechanism is preferably further operative for automatically propelling the toy on a supporting surface as the mouth is automatically moved to the closed position. Still further, the game apparatus preferably includes means for producing a screeching sound as the mouth is automatically moved to the closed position thereof.

Accordingly, it is seen that the toy game apparatus of the instant invention can be effectively utilized in an intriguing toy game, wherein game players are required to individually remove the game pieces or teeth from the mouth of the character figure. In this regard, as the teeth are individually removed from their respective sockets the operating mechanism is operative for sensing the removal of a randomly preselected tooth and for automatically closing the mouth portion when the preselected tooth is removed from its socket. When this occurs the game player who removes the preselected tooth is normally penalized by being excluded from further play during the course of a game. In this manner, a winner is finally selected as the final remaining game player after the other game players have been excluded from game play.

Accordingly, it is a primary object of the instant invention to provide an effective toy game apparatus comprising a character figure having a plurality of removable teeth.

Another object of the instant invention is to provide an effective toy game apparatus which is formed in the configuration of an action figure and operative in a toy game, wherein game players are required to remove teeth from the mouth of the character figure.

An even still further object of the instant invention is to provide a toy game apparatus comprising a character figure having a plurality of teeth in the mouth thereof, wherein the mouth of the character figure is automatically moved to a closed position upon the removal of a randomly preselected tooth therefrom.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
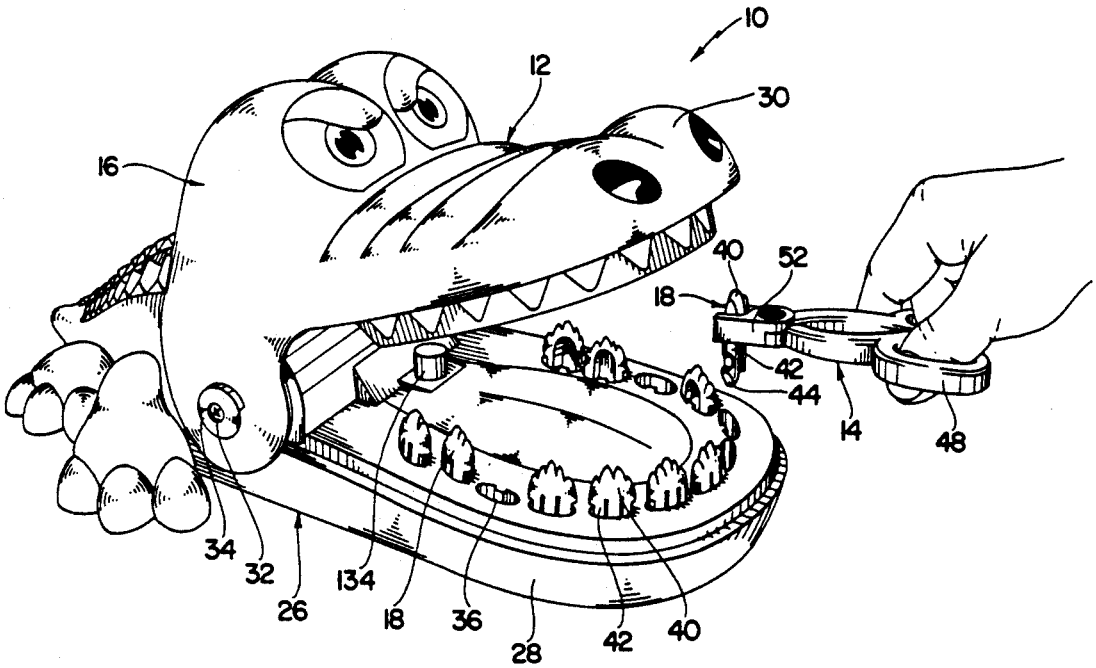
FIG. 1 is a perspective view illustrating the operation of the toy game apparatus of the instant invention.
Figure 8:
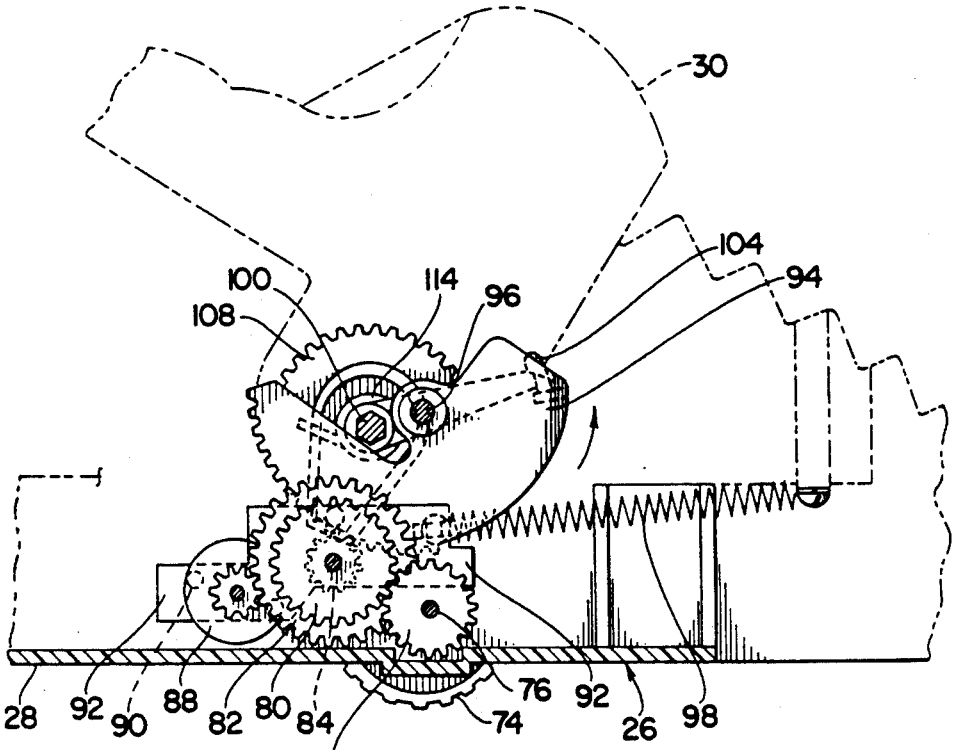
Figure 9:
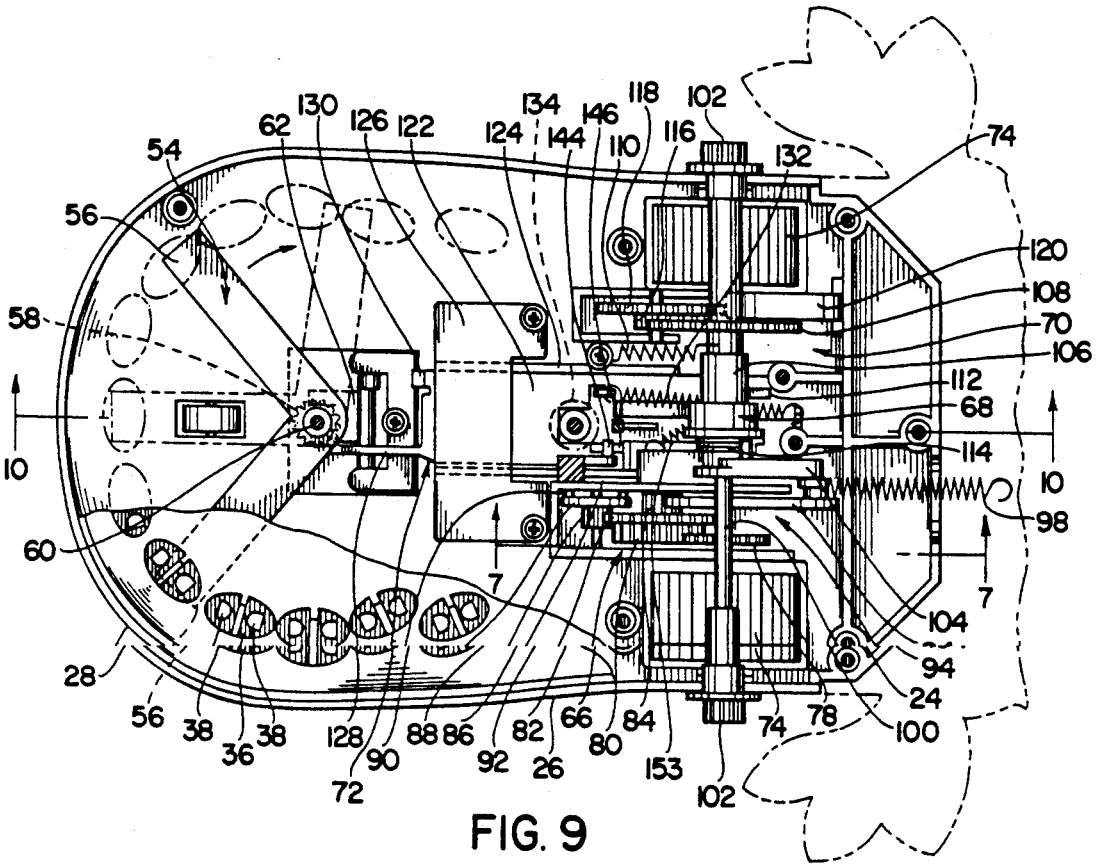
FIG. 9 is a top plan view of the drive mechanism.
Figure 10:
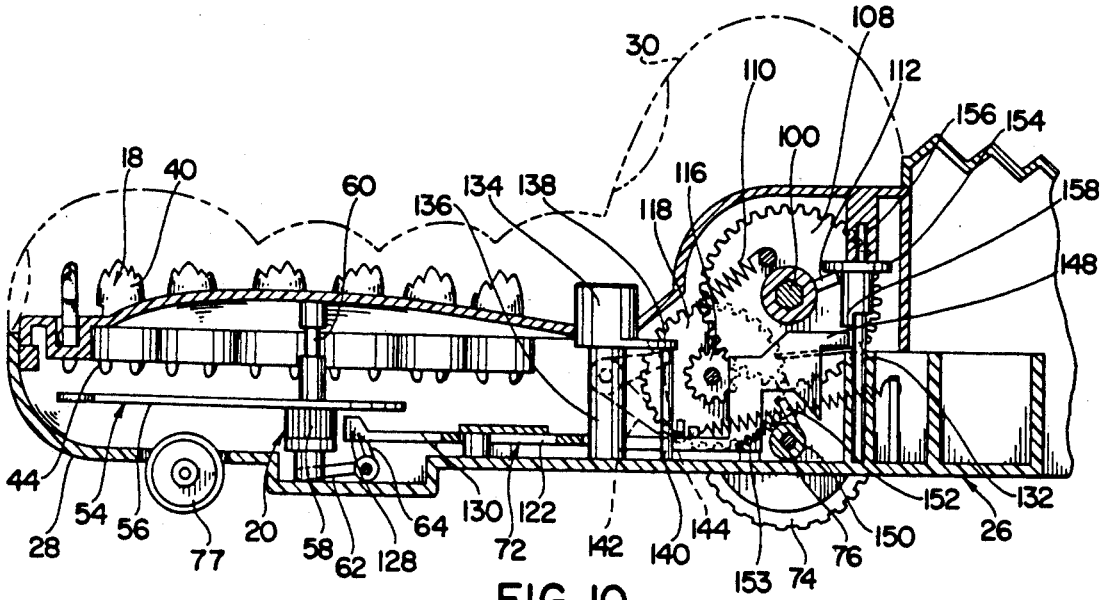
FIG. 10 is a sectional view taken along line 10—10 in FIG. 9.

Referring now to the drawings, the toy game apparatus of the instant invention is illustrated and generally indicated at in FIG. 1. The toy game apparatus 10 comprises an action character figure assembly generally indicated at 12 and a pliers generally indicated at 14. The action character assembly 12 includes a character figure housing assembly generally indicated at 16, a plurality of game pieces generally indicated at 18, a detecting mechanism generally indicated at 20 in FIGS. 9 through 12, and an automatic operating mechanism generally indicated at 24 in FIGS. 9 through 12. During use of the game apparatus 10 the game pieces 18 are removably received in the character figure housing assembly 16, and the detecting mechanism 20 is operative for detecting the removal of at least one randomly preselected game piece 18 from the housing assembly 16. The automatic operating mechanism 24 is operative for retaining the character figure housing assembly 16 in the open position thereof illustrated in FIGS. 1, 8, and 11, and it is responsive to the detecting mechanism 20 for automatically moving the housing assembly 16 to the closed position thereof illustrated in FIGS. 1, 10, and 12. The automatic operating mechanism 24 is further operative for simultaneously producing a screeching sound, and for propelling the character figure assembly 12 forwardly on a supporting surface as the housing assembly 16 is moved to the closed position thereof. Accordingly, the character figure assembly 12 is operative in an amusing game wherein game players manipulate the pliers 14 to remove the game pieces 18 from character figure housing assembly 16 until the automatic operating mechanism 24 is automatically actuated in response to the removal of the randomly preselected game piece for moving character figure housing assembly 16 to the closed position.

Figure 7:
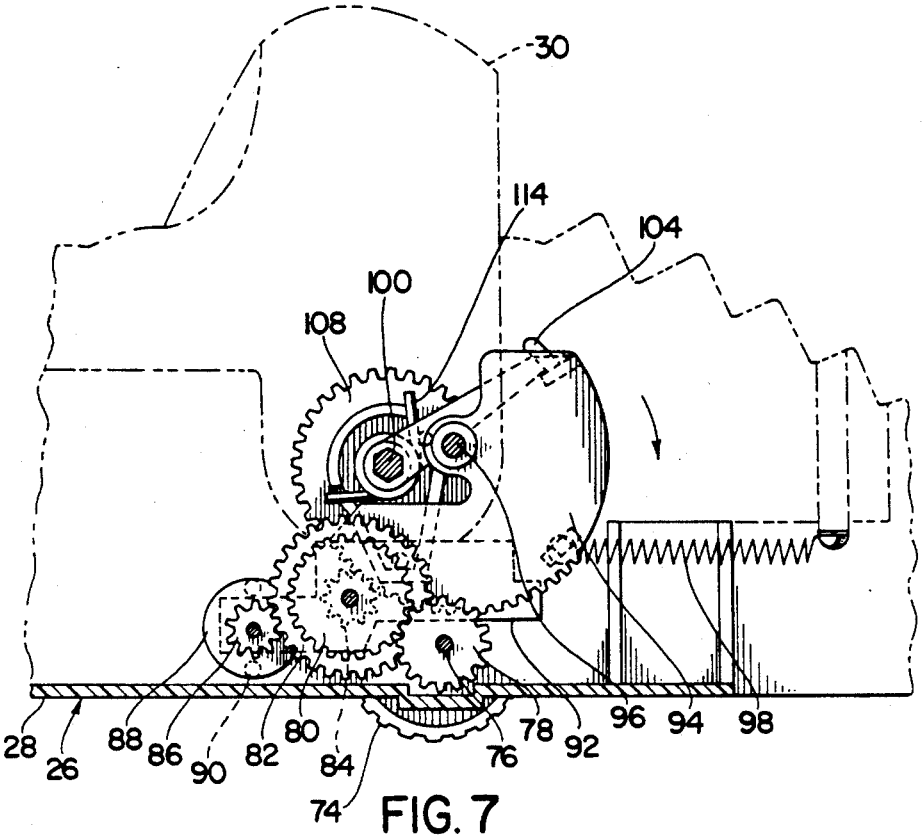
FIGS. 7 and 8 are side sectional views of the drive mechanism.

The character figure housing assembly 16, as hereinembodied, is formed in the configuration of a crocodile character figure, and it includes a base or lower body portion generally indicated at 26, which includes a lower jaw portion 28, and an upper head and jaw portion 30. The upper head and jaw portion 30 is hingeably attached to the lower jaw portion 28, so that the housing assembly 16 is pivotable between the open position illustrated in FIGS. 1, 8, and 11 and the closed position illustrated in FIGS. 7, 10, and 12. In this regard, the upper head and jaw portion 30 is attached to the automatic operating mechanism 24 With screws 32 and end caps 34, and the Operating mechanism 24 is received and secured in the base portion 26. Accordingly, the upper head and jaw assembly 30 is actually pivotally mounted on the lower jaw portion 28 with the operating mechanism 24. Formed in the lower jaw portion 28 is a plurality of sockets 36 which are adapted for releasably receiving the game pieces 18 therein, and which therefore are positioned adjacent the perimeter of the lower jaw portion 28. Each of the sockets 36 has a pair of apertures 38 formed in the lower end thereof for releasably securing one of the game pieces 18 in the socket 36 thereof, as will hereinafter be more fully set forth.

Figure 4:
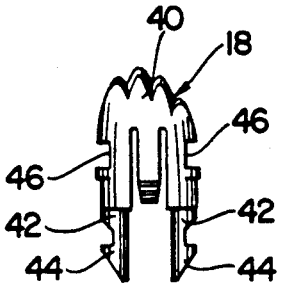
FIG. 4 is a front elevational view of one of the teeth thereof.
Figure 5:
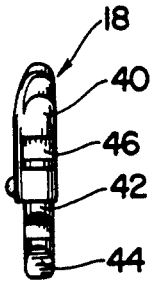
FIG. 5 is a side elevational view of one of the teeth thereof.
Figure 6:
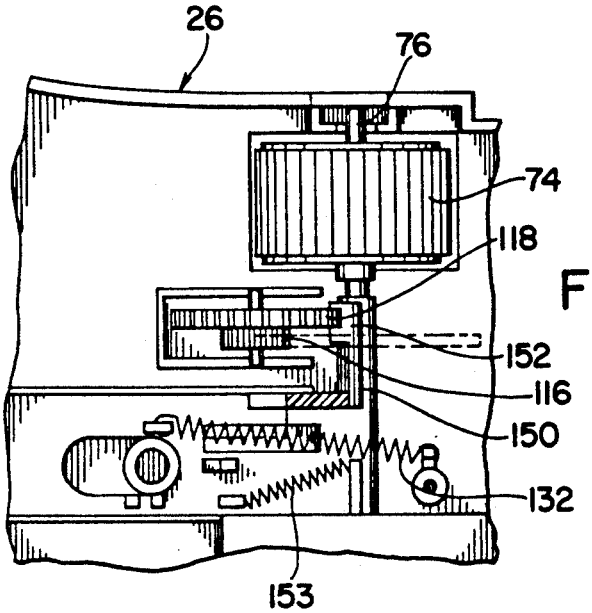
FIG. 6 is a fragmentary top plan view of a portion of the drive mechanism of the apparatus.

As illustrated most clearly in FIGS. 4 and 5, each of the game pieces 18 is formed in the configuration of a tooth of the crocodile character embodied in the character figure assembly 12. Each of the game pieces 18 comprises an upper tooth portion 40, and a pair of spaced downwardly extending resilient root portions or legs 42 having terminal latches 44 thereon. Each of the game pieces 18 is releasably receivable in one of the sockets 36 so that the root portions 42 thereof extend downwardly through the apertures 38 in the socket 36 thereof, and so that the latches 44 are disposed on the underside of the bottom wall of the socket 36 thereof for releasably retaining the game piece 18 therein. Each of the game pieces 18 further has a pair of notches 46 formed in the upper tooth portion 40 thereof. Each of the game pieces 18 is removable from the respective socket 36 thereof by engaging the upper tooth portion 40 thereof in the notches 46 thereof to deflect the root portions 42 thereof inwardly and together so that the latches 44 thereof are disengaged from the bottom wall of the socket 36 thereof.

Figure 2:
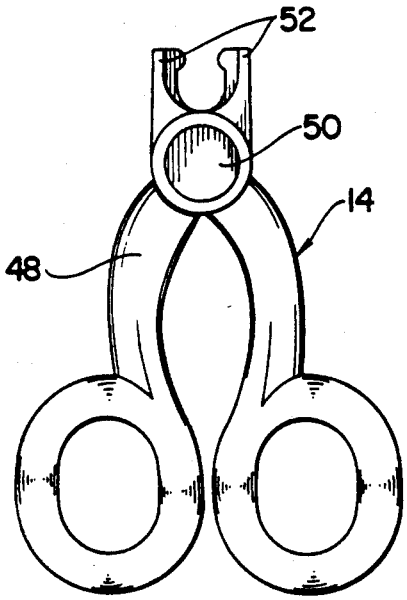
FIG. 2 is a plan view of the pliers of the game apparatus.
Figure 3:
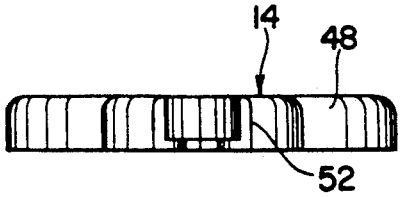
FIG. 3 is an end elevational view of the pliers.

The pliers 14 are illustrated most clearly in FIGS. 1 and 2, and they comprise a pair of plier members 48 which are pivotally connected in a scissors-like manner at 50. The jaw portions 52 are receivable in engagement with I the notches 46 and the game elements 18 so that they are operable for urging the root portions 44 inwardly and together in order to release the game elements 18 from the socket 36 thereof.

Figure 11:
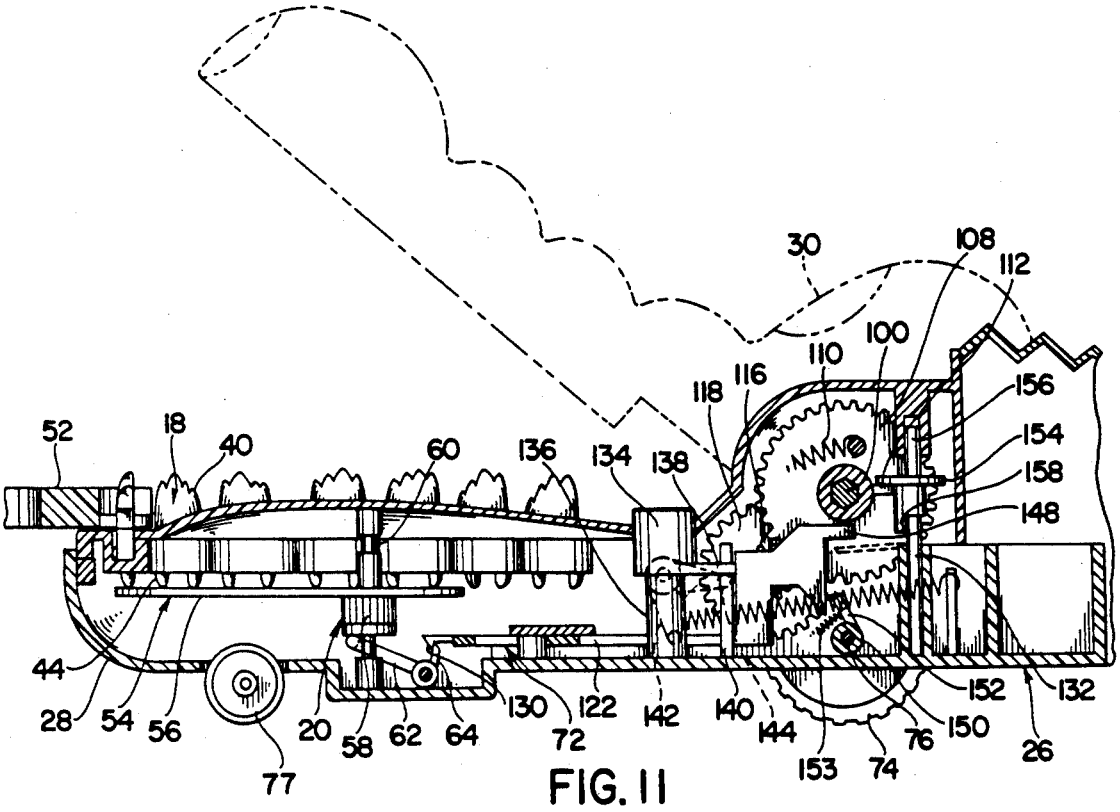
FIGS. 11 and 12 are similar side sectional views illustrating the operation of the toy game apparatus.

The detecting mechanism 20 is operative for detecting the removal of a random preselected tooth 18, or a randomly preselected pair of teeth, from the respective socket or sockets 36 thereof, and it is illustrated most clearly in FIGS. 9 through 12. The detecting mechanism 20 comprises a swivel arm member 54 comprising a pair of swivel arms 56 which are disposed in angular orientation to each other. The detecting mechanism 20 further comprises a sprocket 58 which is integrally formed with the swivel arm member 54 and a shaft 60 which is operative for rotatably mounting the sprocket 58 and the swivel arm member 54, so that the swivel arm member 54 is rotatable in a substantially horizontal plane. The swivel arm member 54 is constructed so that the swivel arms 56 thereof pass beneath the sockets 36 and are engageable with the latches 44 of the adjacent teeth 18 to maintain the swivel arm member 54 in a lowered position, as illustrated most clearly in FIG. 9. The detecting mechanism 20 further comprises an actuating lever 62 which is pivotally mounted in the lower jaw portion 28, so that it is operative for moving the detecting arm member 54 and the sprocket 58 from the lowered position illustrated in FIG. 10 to the elevated position illustrated in FIG. 11. As illustrated, the actuating lever 62 includes a latch arm 64 which is operative for retaining the operating mechanism 24 in an unactuated position, as illustrated in FIG. 11 and as will hereinafter be more fully set forth. When the latch arm 64 is in the substantially vertical position illustrated in FIG. 11, wherein it is operative for retaining the operating mechanism in the unactuated position, the swivel arm member 54 is positioned so that at least one of the swivel arms 56 engages one or both of the latches 44 of one of the game pieces 18 to retain the swivel arm member 54 in a lowered position. However, when the game piece 18 engaged by the swivel arm member 54 is removed from its socket 36, assuming that the swivel arm member 54 is not in engagement with any other latches 44, the swivel arm member 44 is free to move upwardly to the position illustrated in FIG. 12 so that the latch arm 64 is disengaged from the operating mechanism 24, causing the operating mechanism 24 to be fully actuated.

The operating mechanism 24 is illustrated in FIGS. 6 through 12, and it includes a drive assembly 66, a jaw assembly 68, a noisemaker assembly 70, and an actuator plate assembly 72. The actuator plate assembly 72 is actuated by the detecting mechanism 20 for simultaneously actuating the drive assembly 66 to propel the character figure assembly 12 forwardly on a supporting surface, actuating the noisemaker assembly 70 to produce a screeching sound, and actuating the jaw operating assembly 68 to pivot the upper jaw and head portion 30 downwardly to a closed position.

The drive assembly 66 comprises a pair of drive wheels 74, which are rotatably mounted on an axle 76, a main drive gear 78 on the axle 76, a front supporting wheel 77, a pair of integrally formed intermediate drive gears 80 and 82, and a pinion gear 84, which is mounted in co-axial relation with the intermediate drive gears 80 and 82 and communicates therewith through an internal ratchet mechanism (not shown) located in the interior of the intermediate drive gear 82. Accordingly, the pinion gear 84 is operative for communicating rotation to the gears 80 and 82 in a direction which causes the gear 80 to rotate the drive gear 78 so as to propel the character FIG. 12 in a forward direction. The drive assembly 66 further comprises a pinion gear 86 which is rotatably mounted on a shaft (not shown) and integrally formed with a disc 88, having a plurality of lugs 90 formed on an inwardly facing surface thereof. Also included in the drive mechanism 66 is a slide member 92 which is movable between the rearward position illustrated in FIG. 7, and the forward position illustrated in FIG. 8. When the slide member 92 is in the forward position thereof it engages one of the lugs 90 on the disc 88 to prevent the disc 88 from rotating, and to therefore prevent the pinion gear 86, the secondary gears 82 and 80, and the drive gear 78 from rotating. However, when the slide member 92 is in the rearward position thereof it is completely disengaged from the disc 88, so that the gears in the drive assembly 66 are free to rotate in order to propel the action figure assembly 12 in a forward direction on a supporting surface. Further included in the drive assembly 66 is an arcuate gear segment 94 which is pivotally mounted on a shaft 96, so that the segment 94 intermeshes with the pinion gear 84. The gear segment 94 is biased toward a rearwardly pivoted position on the shaft 96 by means of a spring 98. Accordingly, when the slide member 92 is in the rearward position thereof, and the gear segment 94 is released from its forwardly pivoted position, the gear segment 94 causes the pinion gear 84 to be rotated, whereby the wheels 74 are rotated to drive the action character figure assembly 12 in a forward direction on a supporting surface.

The jaw operating assembly 68 comprises a main shaft 100 of non-circular configuration having end members 102 on opposite ends thereof which are receivable in non-rotatable relation in sockets (not shown) in the upper head and jaw portion 30. Screws 32 are receivable in engagement in the end members 102 for retaining the end caps 34 in engagement with the end members 102 in order to non-rotatably secure the upper head and jaw portion 30 to the shaft 100. Also included in the jaw operating assembly 68 is a drive arm 104 which is non-rotatably received on the shaft 100, and engageable with the gear segment 94 for moving the gear segment 94 to a forwardly pivoted position against the bias of the spring 98. A sleeve 106 is rotatably received on the shaft 100, and a noisemaker assembly drive gear 108 is integrally formed on the sleeve 106. The sleeve 106 is biased toward a forwardly rotated position by a spring 110 and a release arm 112 extends rearwardly from the sleeve 106. The sleeve 106 is biased toward a forwardly rotated position relative to the drive arm 104 by means of a torsion spring 114. A slide arm (not shown) having a lug (not shown) thereon extends outwardly from the lower portion of the sleeve 106 and is received in engagement with the slide member 92 for preventing rotation of the drive assembly 66 when the jaw operating assembly 68 is in a predetermined orientation corresponding to the open position of the character figure housing assembly 16, wherein the upper jaw and head portion 30 is pivoted upwardly. However, the lug on the slide arm on the sleeve 106 is operative for moving the slide member 92 rearwardly as the upper jaw and head portion 30 is pivoted downwardly, so that the drive assembly 66 can rotate to drive the action character figure assembly 12 in a forward direction on a supporting surface.

The noisemaker assembly 70 comprises the gear 108, a pinion gear 116, a noisemaker gear 118, and a noisemaker element 120. The gear 108 is received in intermeshing engagement with the pinion gear 116, and the pinion gear 116 is integrally formed with the noisemaker gear 118. The noisemaker element 120 comprises a sheet metal strip which is mounted so that the end thereof engages the noisemaker gear 118 to produce a screeching noise as the noisemaker gear 118 is rotated. Accordingly, when the upper jaw and head portion 30 is pivoted downwardly the gear 108 rotates the pinion gear 116 so that the noisemaker gear 118 is rotated causing the noisemaker element to be passed over the teeth of the noisemaker gear 118 to produce a screeching sound.

The actuator plate assembly 72 comprises an actuator plate 122 which is slidable in a pair of tracks 124 and retained therebetween by a cover plate 126. The actuator plate 122 includes a randomizing finger 128 which engages the gear 58 to rotate the swivel arm member 54 as the actuator plate 122 is moved forwardly or rearwardly. The actuator plate 122 further includes a latch 130 which is engageable with the latch arm 64 for releasably retaining the actuator plate 122 in a forward position as long as the swivel arm member 54 is not in the upper released position thereof illustrated in FIG. 12. In other words, as long as the swivel arm member 54 is retained in a slightly lowered position by the latches 44 of one or more of the game elements 18, the latch arm 64 is engageable with the latch element 130 for retaining the actuator plate 122 in the forward position. The actuator plate 122 is biased toward a rearward position with a spring 132. A downwardly depressible actuator button 134 is received on a post 136 which extends upwardly from the base 26. The button 134 includes an apertured guide plate 138 and a guide post 140 travels in the aperture in the guide plate 138 to retain the button 134 in a predetermined orientation. Also included in the actuator plate assembly 72 is a lever arm 142 which is engaged by the guide plate 138 so as to pivot the lever arm 142 downwardly as the button 134 is depressed. Integrally formed with the lever arm 142 is a secondary lever arm 144 which pivots forwardly as the lever arm 142 is pivoted downwardly. The lever arm 144 is received between a pair of posts 146 which extend upwardly from the actuator plate 122 so that the actuator plate 122 is moved forwardly as the button 134 is depressed. Accordingly, by depressing the button 134 the actuator plate 122 can be moved forwardly to a position where the latch 130 engages the latch arm 64 to retain the actuator plate 122, in a forward position against the bias of the spring 132. However, when the latch arm 64 is released from the latch 130, the actuator plate 122 is returned to a rearward position by the spring 132. Further included in the actuator plate assembly 72 is an upper arm 148 which is integrally formed on the actuator plate 122 so that it extends upwardly therefrom beneath the jaw operating assembly 68, and a cam sleeve 150 is rotatably received on the axle 76. The cam sleeve 150 includes a cam pawl 152 Which normally engages the noisemaker gear 118 to prevent rotation thereof when the cam sleeve 150 is in a forward position. A spring 153 is provided for biasing the cam sleeve 150 to a forward position. The cam pawl 152 is engaged by the upper arm 148 as the actuator plate 122 is moved rearwardly to move the cam pawl 152 away from the gear 118 until the upper arm cams past the cam pawl 152. Still further included in the actuator plate assembly 72 is a release disc 154 which is slidably mounted on a vertical shaft 156. The release disc 154 includes a downwardly extending leg 158 which normally prevents the upper arm 148 from reaching a fully rearward position, wherein it is in engagement with, or closely adjacent to, the shaft 156. As a result, the leg 158 is operative for preventing the upper arm 148 from camming past the cam pawl 152. However, the release disc 154 is positioned directly above the release arm 112, and therefore as the release arm 112 is pivoted upwardly the release disc 154 is moved upwardly, so that the leg 158 is removed from the path of the upper arm 148. Accordingly, as the upper arm 148 advances rearwardly it initially releases the cam pawl 152 from engagement with the gear 118, so that the gear 108 is rotated causing the sleeve 106 and the release arm 112 to also be rotated. As the release arm 112 is pivoted upwardly it moves the release disc 154 upwardly, so that the upper arm 148 can cam past the cam pawl 152 and move to its fully rearward position, wherein it is in engagement with or closely adjacent to the shaft 156. As a result of this operation, the noisemaker assembly 70 is actuated to produce a screeching sound of short duration as the gear 118 is rotated past the noisemaker element 120. Further, as the gear 108 is rotated with the sleeve 106 so that the upper arm 148 is advanced rearwardly the shaft 100 is rotated to pivot the upper jaw and head portion 30 toward a closed position, and the arm 104 is pivoted upwardly to release the gear segment 94, so that the drive assembly 66 is operated for propelling the action character figure assembly 12 forwardly on a supporting surface. In this regard, as the arm 104 is pivoted upwardly in this manner the slide 92 is moved rearwardly to release the slide 92 from engagement with the lugs 90 on the disc 88, so that the gears in the drive assembly 66 are freely rotatable for driving the wheels 74 as the gear segment 94 is pivoted rearwardly by the spring 98.

Figure 12:
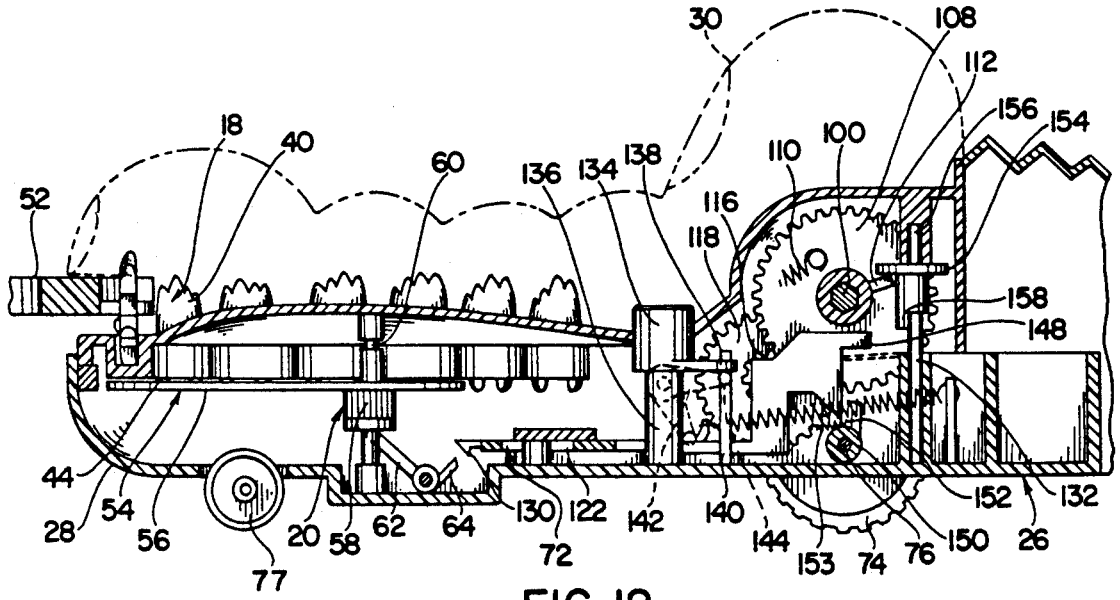

Accordingly, for use and operation of the toy game apparatus 10 the upper head and jaw portion 30 is pivoted upwardly and rearwardly to the open position illustrated in FIG. 1. As the upper head and jaw portion 30 is pivoted upwardly the gear 118 is advanced past the pawl 152, and the pawl 152 prevents reverse rotation of the gear 118, so that the noisemaker assembly 70, the jaw operating assembly 68, and the drive assembly 66, are prevented from rotating, and so that the upper head and jaw portion 30 is maintained in the open position thereof. The game elements 18 are then assembled in the sockets 36, so that the root portions 44 extend downwardly slightly below the bottom walls of the socket 36. The actuator button 134 is then depressed so that the actuator plate assembly 72 is moved forwardly. As this occurs the arm 128 reorients the position of the swivel arm member 54, and the latch arm 64 engages the latch 130 to retain the actuator plate assembly 72 in the forward position thereof. The swivel arm member 54 is moved upwardly into engagement with the root portion 44 of at least one of the game elements 18 as illustrated in FIG. 11. Thereafter, game players must use the pliers 14 to individually remove the game elements 18 from the sockets 36. When the randomly preselected game element 18 which is retaining the detecting arm assembly 54 in the slightly downward position illustrated in FIG. 11 is removed from the socket 36 thereof, so that the swivel arm member 54 is moved further upwardly to the position illustrated in FIG. 12, the latch arm 64 is disengaged from the latch 130. This causes the actuator plate assembly 72 to be moved to the rearward position thereof by the spring 132. As the actuator plate assembly 72 is moved rearwardly the upper arm 124 engages the cam sleeve 150 to disengage the cam 152 from the gear 118 actuating the noisemaker assembly 70, the jaw operating assembly 68, and the drive assembly 66. Specifically, the noisemaker assembly 70 is operated so that the gear 118 passes by the noisemaker element 120 to produce a screeching sound. The jaw assembly 68 is rotated by the gears 108, 120, and 116, and the spring 110, so that the end pieces 102 are rotated to move the upper jaw and head portion 30 to the closed position thereof. As this occurs the arm 104 is moved upwardly to allow the gear segment 94 to swing rearwardly. Further, the slide 92 is moved rearwardly so that it is disengaged from the lugs 90 on the disc 88 permitting the gears 86, 82, 84, 80, and 78, to be rotated by the gear segment 94 causing the axle 76 and the wheels 74 to be rotated for propelling the action character figure assembly 12 forwardly. Consequently, as the one randomly preselected game element 18 which allows the detecting arm assembly 54 to be moved further upwardly is removed from the socket 36 thereof, the upper head and jaw portion 30 is immediately pivoted downwardly to the closed position thereof, the noisemaker assembly 70 is operated for producing a screeching sound, and the action character FIG. 12 is propelled forwardly on a supporting surface.

It is seen therefore that the instant invention provides an effective and amusing toy game apparatus. The detecting assembly 20 is randomly reoriented each time the actuator button 134 is depressed, so that game players never know which of the game pieces 18 will cause the action character FIG. 12 to be moved to the closed position thereof. However, when the randomly preselected game piece 18 which allows the detecting arm assembly 54 to be moved to the upward position thereof illustrated in FIG. 12 is released, the upper head and jaw portion 30 is immediately automatically moved to the closed position thereof while the noisemaker assembly 70 produces a screeching sound and the drive assembly 66 propels the action character figure assembly 12 forwardly on a supporting surface. Hence, it is seen that the toy game apparatus 10 represents a significant improvement in the toy art and that it has a high level of play value and substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy game apparatus comprising:

a. a character figure having a mouth portion which is moveable between open and closed positions, said mouth portion having a plurality of game piece sockets therein;

a plurality of game pieces moveably received in said game piece sockets;

c. detecting means for detecting the movement of a game piece from a predetermined normal position in at least one of said game piece sockets;

d. means for releasably retaining said mouth portion in the open position thereof; and e. means for automatically moving said mouth portion to the closed position thereof in response to the movement of a game piece from the normal position thereof in said at least one game piece receiving socket as detected by said detecting means.

2. In the toy game apparatus of claim 1, said detecting means detecting the movement of a game piece from at least one randomly preselected game piece socket.

3. In the toy game apparatus of claim 1, said game piece sockets being disposed adjacent the perimeter of said mouth portion, said game pieces comprising teeth which are individually moveable from the normal positions thereof in said mouth portion.

4. In the toy game apparatus of claim 3, said mouth portion comprising upper and lower jaw portions, said game piece sockets being disposed in said lower jaw portion.

5. In the toy game apparatus of claim 3, said game pieces being individually removable from the respective game piece sockets thereof for moving said game pieces form the normal positions thereof.

6. In the toy game apparatus of claim 5, said teeth each comprising a pair of spaced resilient downwardly extending root portions which are releasably receivable in said sockets for releasably securing said teeth in said sockets, said root portions being deflectable inwardly and together for individually releasing said teeth from said sockets.

7. The toy game apparatus of claim 6, further comprising scissors-like plier means individually engageable with the root portions of said teeth for removing said teeth from the respective sockets thereof.

8. The toy game apparatus of claim 1 further comprising wheel means for movably supporting said character figure on a supporting surface and propelling means for automatically propelling said toy on said supporting surface as said mouth is automatically moved to the closed position thereof.

9. The toy game apparatus of claim 1, further comprising means for producing a screeching sound as said mouth is automatically moved to the closed position thereof.

10. The toy game apparatus of claim 1, further comprising manually operable actuator means for actuating said means for automatically moving said mouth when said mouth is in the open position thereof.

11. A toy game apparatus comprising:

a. a housing including hingeably connected upper and lower housing portions said upper housing portion being hingeable relative to said lower housing portion between an open position wherein said upper housing portion is hinged upwardly relative to said lower housing portion and a downwardly hinged closed position wherein said upper housing portion is received on said lower housing portion, said lower housing portion having a plurality of game piece sockets therein;

b. a plurality of game pieces moveably received in said game piece sockets;

c. detecting means for detecting the movement of a game piece from a normal position in at lest one of said game piece sockets;

d. means for releasably retaining said housing in the open position thereof; and e. means responsive to said detecting means for automatically moving said housing to the closed position.

12. In the toy game apparatus of claim 10, said game pieces being individually removeable from the respective game piece sockets thereof for moving said game pieces from the normal positions thereof.

* * * * *